United States Patent [19]

Morrison et al.

[11] 4,059,953

[45] Nov. 29, 1977

[54] TIMEPIECE CALENDAR INDEXING APPARATUS

[75] Inventors: David Morrison, Atlanta, Ga.; Donald J. Rogers, Huntersville, N.C.

[73] Assignee: General Time Corporation, Thomaston, Conn.

[21] Appl. No.: 697,682

[22] Filed: June 18, 1976

[51] Int. Cl.[2] ..... G04B 19/24

[52] U.S. Cl. ..... 58/4 R; 58/4 A; 58/5; 58/58

[58] Field of Search ..... 58/4 R, 4 A, 5, 58

[56] References Cited

U.S. PATENT DOCUMENTS

| | | | |
|---|---|---|---|
| 3,721,085 | 3/1973 | Zaugg | 58/58 |
| 3,744,237 | 7/1973 | Muto | 58/58 |
| 3,751,901 | 8/1973 | Meitinger et al. | 58/58 |
| 3,771,308 | 11/1973 | Visconti et al. | 58/58 |
| 3,818,692 | 6/1974 | Zaugg et al. | 58/58 |
| 3,911,667 | 10/1975 | Komiyama | 58/58 |

*Primary Examiner*—Stanley J. Witkowski
*Attorney, Agent, or Firm*—Pennie & Edmonds

[57] ABSTRACT

An indexing apparatus for changing automatically and rapidly calendar information of a clock includes an indexing assembly having both day and date means, each engageable with for driving respective day and date discs provided with calendar indicia. A cam driven by the drive train of the clock mechanism rotates through a full revolution each 12-hour period. A member including a plurality of gear teeth arranged in a sector is mounted for pivota movement against the bias of a spring which positions the member in the path of movement of the cam. The indexing assembly, further, includes an element formed by a disc and a sector gear which is driven in opposite directions by the member whose gear teeth are in driving engagement therewith. The disc of the element includes a pair of substantially diametrically oppositely disposed notches having oppositely inclined ramps between the upper and lower surfaces of the clutch disc. The components of the indexing assembly are mounted in a stack with the day means between the date means and the element. The day means includes a pair of follower projections which normally are disposed within the notches, the day means being movable with the element in one direction to index the day disc through a partial revolution yet will idle upon movement of the element in the other direction whereby the teeth ride out of the notches along the ramps. Means are provided to prevent movement of the day and date means during idling. The day disc includes a plurality of projections which sequentially engage the date means so that upon each second index of the day means the date disc undergoes an indexing movement in the one direction. The calendar information, also, may be changed selectively by a clutch arrangement activated by a setting stem.

24 Claims, 15 Drawing Figures

TIMEPIECE CALENDAR INDEXING APPARATUS

BACKGROUND OF THE INVENTION

The present invention relates both to a timepiece having a display including indicia representing calendar information such as the particular day of the week, the date of the month and includes with the day presentation a presentation either of "AM" or "PM" and to the apparatus for automatically or selectively controlling the operation of the calendar display through substantially rapid index following each 12-hour and 24-hour period.

Timepieces of the type generally relating to the timepiece of the present invention to be set out hereafter having a day indicator and/or data indicator are known to the prior art. Representative of the prior art are U.S. Pat. Nos. 3,721,085 to R. Zaugg; 3,744,237 to T. Muto; 3,751,901 to H. Meitinger et al.; 3,771,308 to G. Visconti et al.; 3,818,692 to R. Zaugg et al. and 3,911,667 to K. Komiyama.

Each of the aforementioned prior art patents illustrate and describe timepieces having calendar information including day and/or data indicia. The patents more particularly are directed to mechanisms for advancing at scheduled times each form of indicia through an increment of rotation thereby to move the next following indicia at 12 o'clock midnight into position for viewing at an aperture or apertures formed in the face plate of the timepiece. The mechanisms, all which may be differently characterized, are indicated as being of the type whereby the indexing operation is rapidly carried out so that the next succeeding indicia to be brought into alignment with the viewing aperture or apertures assumes its position within the aperture in a substantially rapid time frame for clear reading of that indicia.

BRIEF DESCRIPTION OF THE INVENTION

The present invention is directed to apparatus for periodically and rapidly changing a display of calendar information including day indicia, date indicia and indicia of the period of the day, i.e., either "AM" or "PM" carried with the day indicia. The apparatus includes support means defining an aperture for viewing the indicia as mechanism is operated to index the indicia automatically or selectively into view. The indicia is carried by a pair of discs which are arranged coaxially about the axis of the mainshaft of the timepiece with which the display of calendar information is associated. The discs, further, are supported so that the indicia is located in a common plane. The mechanism for indexing one or both of the discs through substantially instantaneous stepped advance is controlled by the timepiece thereby to carry out an indexing operation upon completion of each 12-hour period.

The present invention is an improvement over the timepieces of the prior art in that it provides a novel calendar display and the mechanism for indexing the display both automatically at predetermined times during each 24-hour period and selectively as required.

There has thus been outlined rather broadly the more important features of the invention in order that the detailed description thereof that follows may be better understood and in order that the present contribution to the art may be better appreciated. There are, of course, additional features of the invention that will be described hereinafter and which will form the subject of the claims appended hereto. Those skilled in the art will appreciate that the conception upon which this disclosure is based may be readily utilized as a basis for the designing of other structures for carrying out the several purposes of the invention. It is important, therefore, that the claims be regarded as including such equivalent construction as do not depart from the spirit and scope of the invention.

DESCRIPTION OF THE PREFERRED EMBODIMENT

Figure 1:
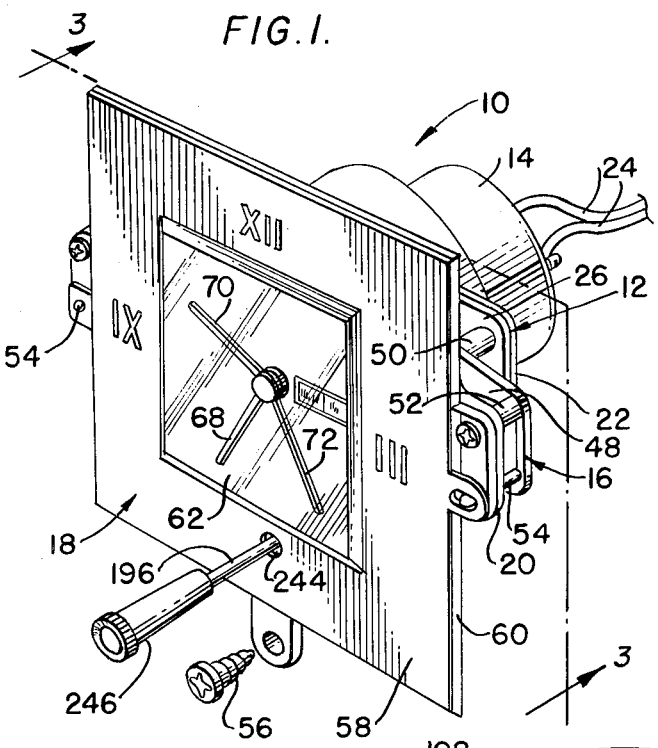
FIG. 1 is a perspective view of the timepiece of the present invention.

The present invention embodied in a timepiece 10 providing the conventional time display hands and drive train is directed to a display of calendar information and to the mechanism for changing the display automatically during each 24-hour period and selectively, as required. The timepiece may be seen to advantage in FIG. 1 while the mechanism for changing the display may be seen and will be described in connection with other ones of the figures of the drawings. The timepiece may be adapted to any manner of utilization including but not limited to use as a wall mounted clock and as an automibile clock to be carried in the dashboard, to name two possible adaptations. Many more adaptations possibly will come to mind as the description continues.

The timepiece 10 includes casing means 12 for supporting a prime mover such as a motor 14 which extends rearwardly of the timepiece and a plate 16 which closely overlies the casing means to the front. As will be described the plate provides mounting structure for mounting both the casing means and the combination of a lens assembly 18 and a mask 20. The particular construction of the casing means does not in and of itself constitute a part of the invention and only those portions of the casing means, as necessary, are illustrated to provide an understanding of the manner of mounting for cooperative interaction the components of the calendar display changing mechanism, be it the mechanism for automatically changing the calendar display during each 24-hour period or for selectively changing the calendar display, as required. Generally, the casing means includes a case front 22 having a dished-out inner portion (not shown) within the area of which is a further dished-out portion. The latter portion may include a shoulder for resting receipt of a flange (not shown) of the casing of motor 14. The motor may be of any suitable type used in the horological arts and may be powered either by an alternating or direct current source connected to the winding by conventional means including conductors 24.

Figure 3:
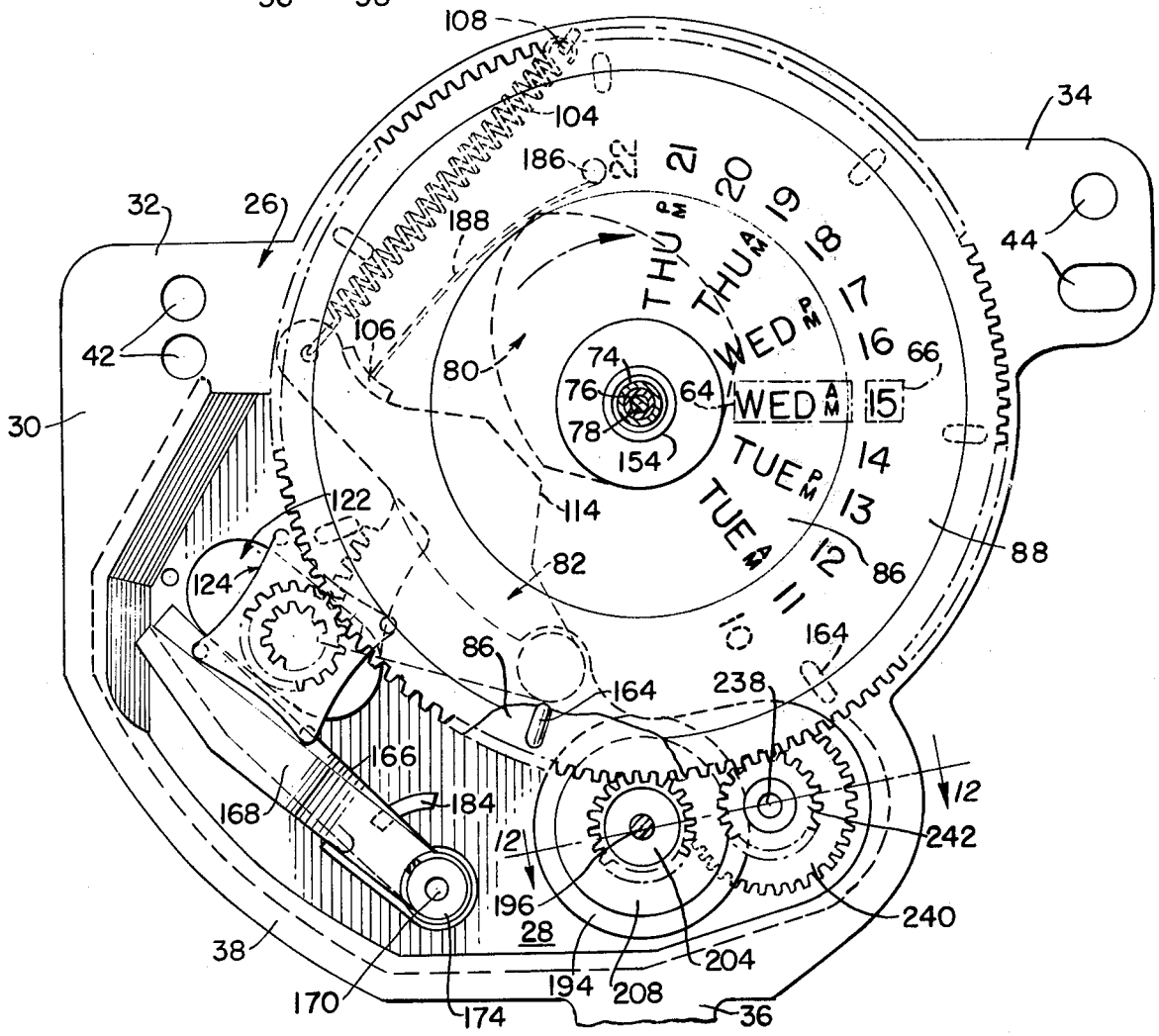
FIG. 3 is a view in vertical section as seen along the line 3—3 in FIG. 1.

The casing means further includes a movement plate 26 which in overall outline substantially is similar to that of the case front. Thus, the movement plate, likewise, includes a dished-out area 28 at least within the confines of an upper surface 30 (see FIG. 2) extending ouward thereby to define a plurality of tabs 32 and 34 and a further tab 36 connected to the surface by a rim 38. The tabs, as illustrated in FIG. 3, are arranged substantially equidistantly around the dished-out area 28. The dished-out area includes a surface which is overall substantially planar and parallel to the upper surface 30. As also illustrated, these surfaces are connected throughout the length of the rim 38 and spaced apart along the length of an opening 40 which accommodates movement of certain components of the calendar display changing mechanism, as will be described. The movement plate 26 is nested within the case front 22 so that their tabs each including at least one aperture overlie one another for purposes of mounting to the plate 16. As illustrated, the tabs 32 and 34 of the movement plate (and the case front) include a pair of apertures 42 and 44. The remaining tab of both structures includes a single aperture 46 (see FIG. 4).

The plate 16 is generally rectangular in overall outline and includes a plurality of extensions 48, each of which supports a boss 50 (only one is shown) in an array to overlie one of the apertures 42 and 44 and the aperture 46. An aligning pin (not shown) is associated with those bosses cooperating with the apertures 42 and 44. To this end, the pins are received through one of the apertures 42 and 44 in receiving the parts together and a plurality of screws (not shown) may be received through the remaining apertures and threaded into the bosses. One of the apertures 44 may be of oval outline to facilitate mounting of the parts.

The plate 16 includes a further plurality of bosses 52 which extend forwardly and in a similar manner certain of the bosses have aligning pins 54 associated therewith. Screws 56 may be received through the lens assembly 18 and mask 20 to secure the same to the plate, once the lens assembly and mask are received over the aligning pins.

Both the mask 20 and lens assembly 18 overall are of rectangular outline. The lens assemblu includes a dial plate 58 and lens 60 having a central viewing area 62 which is raised from the plane of the peripheral portion of the lens. The lens 60 is formed preferably of a material having tranparency characteristics to provide good visibility to the area between the lens and the plate 16 for viewing the hands of the timepiece and the calendar information which will appear at a pair of apertures 64 and 66. The particular material employed in formation of the lens, and for that matter all of the components of the casing means, the mechanism for changing the calendar display and so forth, are not critical to the invention and may be chosen from conventional materials for purposes as are required and/or necessary in their operation. Thus, the material for use in the construction of gearing will be such to permit long life, proper drive, and so forth while other structures may be formed of material thereby to reduce the forces of friction through sliding engagement. Generally, however, the various components will be formed of one of the accepted metals or plastics used in manufacturing like or similar type structures. The dial plate, preferably, is in the form of a film overlay, such as metal-plastic laminate which is supportingly received on the peripheral region of the lens 60. The dial plate may carry therearound indicia either in Roman or Arabic numerals representative of the major divisions of the hour such as indicia of the quarter hours as well as divisions therebetween represented by angled lines. The numerals may be etched into the film so that they may be illuminated along with the central viewing area by a light source (not shown) to facilitate the reading of time. The illumination will be directed to the viewing area 62 of the lens 60 and to the etched indicia in the dial plate by means of the mask 20 received juxtaposed to the rear surface of the lens 60. The mask, therefore, is of an outline similar to that of the lens within the peripheral area. The mask, further, is opaque and includes a rectangular cutout in alignment with each of the numeral etchings. The mask is received on the plate in the same manner by which the lens assembly 18 is so received.

The several hands including the hours 68, minutes 70 and seconds hand 72 of timepiece 10 are driven by a gear train (not shown) connected at the output of the motor 14. The manner of arrangement of such a drive train is well-known. The hands illustrated in FIG. 1 are supported by bushings and shafts 74, 76 and 78, extending from the respective gears through a central opening in the plate 16. The bushings and shafts are supported partially by a lug 154 through which they extend and which by virtue of a somewhat relieved end is received into the central opening. The hands may be press fit or otherwise secured to their support for movement about the longitudinal axis of the timepiece 10. The apertures 64 and 66 previously mentioned while not critical in orientation other than that which becomes necessary by the present description are located between the longitudinal axis and the first quarter hour indicia. The apertures permit viewing of the calendar information, particularly information of the day of the week and the date of the month, which indicia is carried on structure disposed behind the plate 16 and movable into view in a manner to be described. Further indicia in the form of "AM" and "PM", arranged horizontally or vertically, is carried adjacent the indicia f the day thereby to set out each particular 12-hour period.

Figure 2:
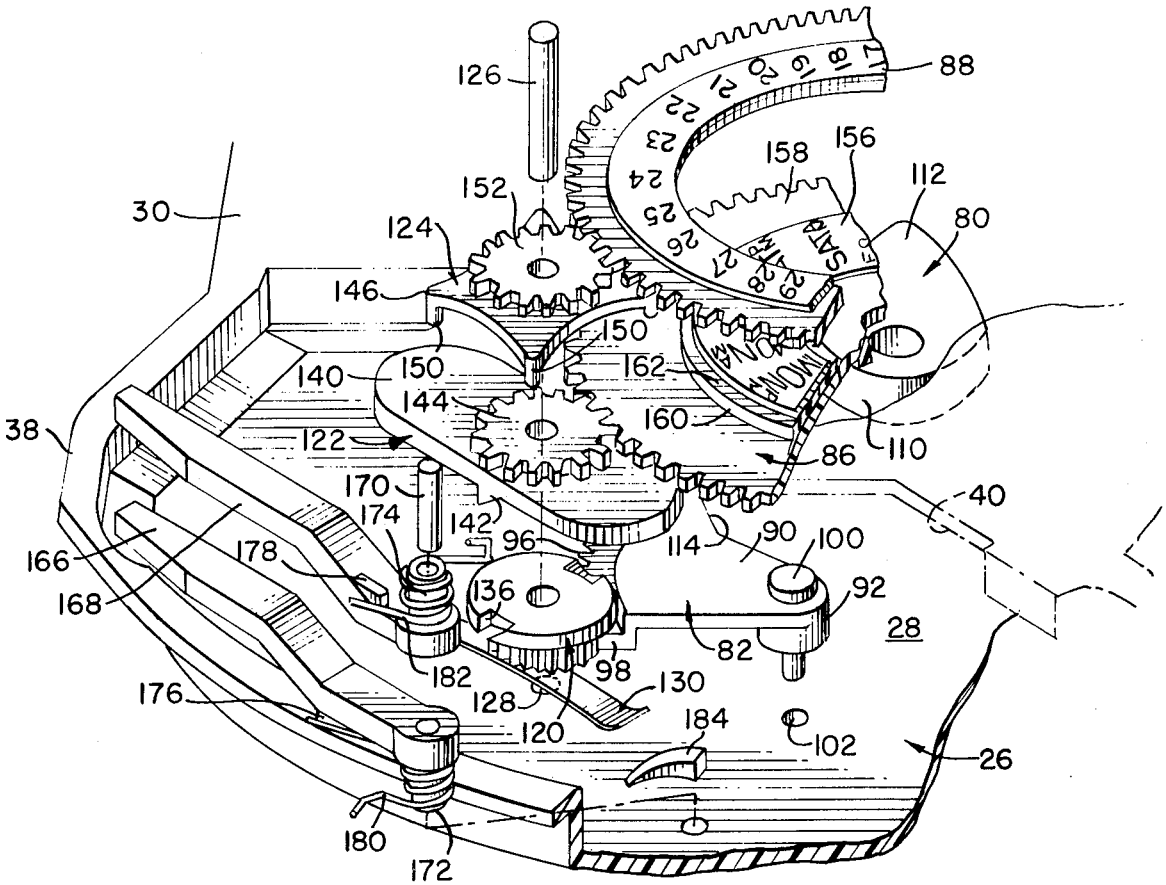
FIG. 2 is an exploded perspective of certain of the components for indexing the calendar display.

The calendar display changing mechanism may be seen to advantage in FIG. 2 illlustrating the components in exploded form and a complete sequence of operation of the mechanism whereby both the day of the week and the date of the month are indexed within a 24-hour period may be seen to advantage in FIGS. 3–6.

Figure 11:
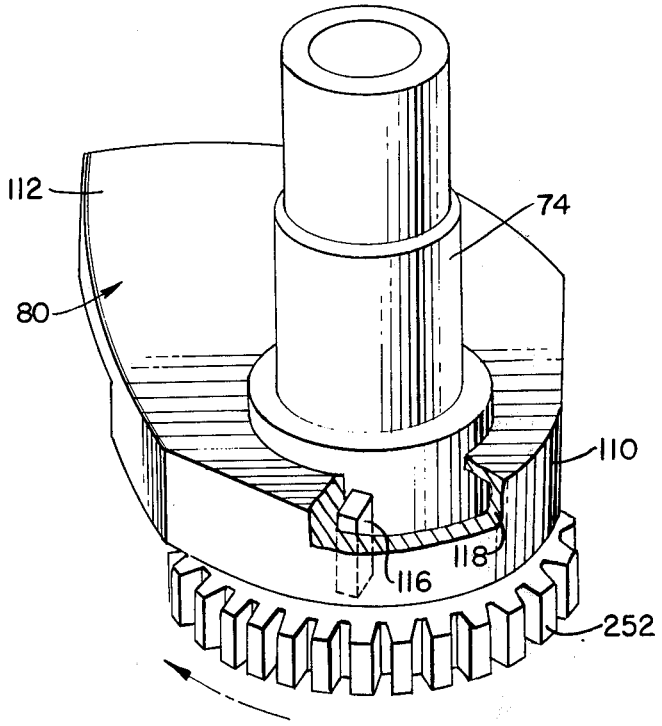
FIG. 11 is a view in perspective of a drive cam and the manner of its mounting on the hour gear.

Referring first to FIG. 2, the calendar display changing mechanism includes a 12-hour cam 80, an indexing sector 82, an indexing assembly 84, a day disc 86 and a date disc 88. The 12-hour cam, as will be described in connection with FIG. 11, is mounted on and rotatable with the bushing 74 of the hour gear, while the other components of the mechanism are supported by the movement plate 26.

The indexing sector includes a body portion 90 having a hub 92 at one end and an arm 94 extending from the body at the other end. A gear sector portion 96 including a plurality of gear teeth is formed therebetween. Particularly, the gear sector portion is formed on an extension 98 of the body which is laterally offset toward the surface within the dished-out area 28 of the movement plate 26. Space considerations, therefore, are taken into consideration.

The indexing sector 82 is mounted by a stud 100 rigidly received as by friction or otherwise in a hole 102 formed in the dished-out area 28. The indexing sector may be received on the stud by means of a bearing or otherwise by smooth surface-to-surface contact for movement about the axis of the stud in one direction of pivotal movement under control of the 12-hour cam and in the reverse direction of pivotal movement under control of spring 104 which biases the indexing section against a stop 106 (see FIGS. 3–6) formed between the dished-out area 28 and upper surface 30 dividing the opening 40 into two open areas. As seen in FIG. 3 the spring is connected at one end to the arm 94 at the other end to a member 108 formed on the underside of upper surface 30 of movement plate 26. The normal positioning of the indexing sector is in the position of biased engagement with the stop 106. In this positon of full clockwise movement, (the direction being referenced to the illustration in FIG. 3, for example) the arm extends through the first open area of opening 40.

As indicated, the 12-hour cam 80 controls movement of the indexing sector 82 in pivotal movement in the counter-clockwise direction. The 12-hour cam includes a hub portion 110 and a tear drop portion 112 extending to a cam surface at the end. In rotation, the 12-hour cam acts against a surface 114 of the indexing sector 82 resulting in the aforementioned movement.

Turning again to FIG. 11, it may be seen that the 12-hour cam is mounted on the bushing 74, thereby being received over and is driven by a projection 116 engaging against one of the side walls of an angular cutout 118. As illustrated in FIG. 2, the 12-hour cam is disposed below the upper surface 30 of the movement plate 28 and upon movement with the hour gear engages the surface 114 of the indexing section 82 through the second open area of opening 40.

Through the arrangement described to this point, the 12-hour cam functions to pivot the indexing section twice during each 24-hour period. Thus, the 12-hour cam pivots the indexing sector at 12 o'clock noon and 12 o'clock midnight at which times the day disc is indexed from (day) "AM" to "PM", the date disc remaining in place, and from "PM" to (next day) "AM", the date disc then also indexing to the next following date indicia representation.

Figure 7:
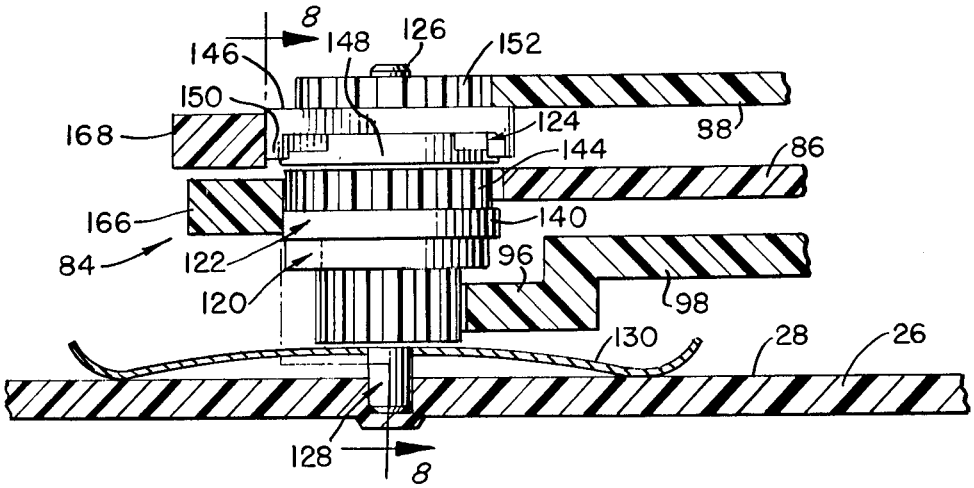
FIG. 7 is an elevational view of the indexing assembly of the present invention.
Figure 8:
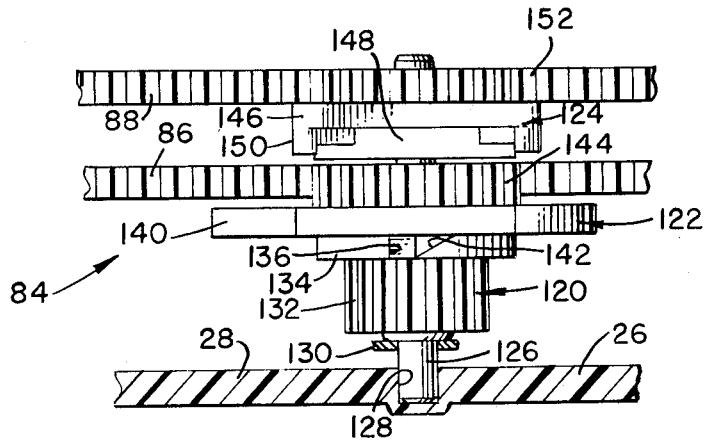
FIGS. 8 and 9 are views similar to FIG. 7, yet turned through 90°, illustrating the indexing assembly in the idling and driving conditions.
Figure 9:
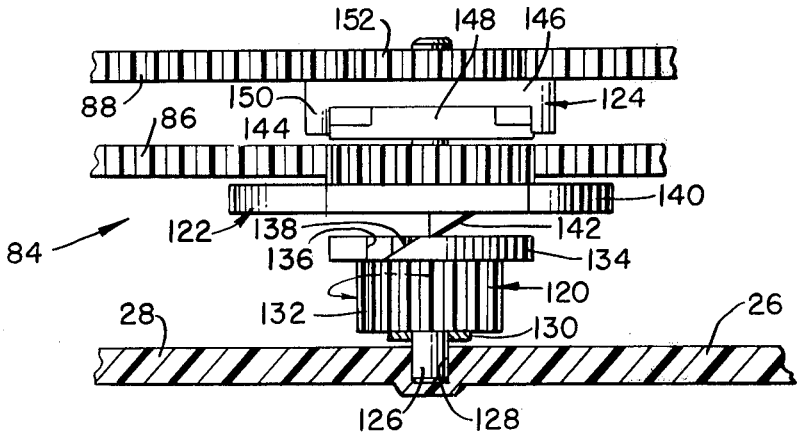

The indexing assembly 84 includes a plurality of structural components such as the indexing pinion 120, day index cam 122 and date index cam 124, all of which are supported by a shaft 126 in a stack (see FIGS. 7–9). The manner of mounting the structure is through receipt of the shaft in an opening 128 formed with a somewhat thickened area in the movement plate 26 as well as within an opening of a hub (not shown) formed on the rear surface of plate 16. The several components of the indexing assembly are biased toward the plate 16 by a leaf spring 130 thereby to reside normally in the FIG. 7 position. While a complete sequence of operation will be discussed below, the indexing pinion through cooperative action of the day index cam will be caused to move to the FIG. 9 position upon pivotal movement counterclockwise of the indexing sector.

Figure 10:
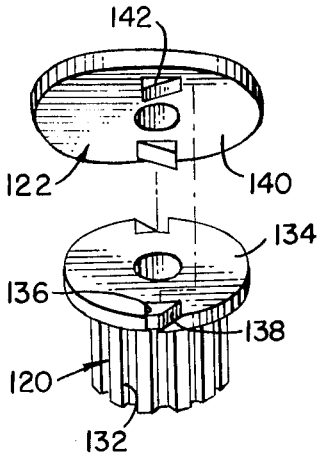
FIG. 10 is a view in perspective of two components of the indexing assembly.

The indexing pinion 120 (see also FIG. 10) is formed by a member including a hub portion 132 having a plurality of gear teeth equal in number to the number of gear teeth carried by the gear section portion and an upper portion 134 (in the direction of the stack of components forming the indexing assembly 84 in FIG. 7). The upper portion includes spaced apart surfaces and a pair of notches 136 including cam tracks 138 of opposite parallel incline leading from one surface to the other at substantially diametrically opposed locations. The arcuate length of each cam track is approximately equal to one-half the arcuate length of each notch. The length of each notch is equal approximately to one-eighth of a complete revolution.

The day index cam 122 includes a plate portion 140 of elongated oval outline. The plate portion provides a pair of diametrically opposed follower projections 142 on a lower surface. The follower projections are of an outline complementary to that of for cooperation with the cam tracks and surface of the upper portion of the indexing pinion. One of the extensions or paddles of the plate portion which shall extend along the major axis from the axis of rotation is shorter than the other extension for the reason as will be brought out. The day index cam also includes a pinion 144 which may be integral with or supported on the upper surface of the plate 140.

Finally, the date index cam includes a plate portion 146 and a hub 148 depending from a lower surface. A plurality of ribs (not shown) extend from the hub for purposes of strengthening a number of pins 150, also depending from the lower surface of the plate portion. The pins are disposed at the corners of the plate portion having opposite concave side surfaces of equal length. A pinion 152, likewise, may be integral with or supported by the upper portion of the plate portion 146. As with the discussion of the indexing pinion the upper surface of the plate portions of the day and date indexing cams is the surface in the direction of the stack of components forming the indexing assembly 84.

The day disc 86 is arranged to be driven by the pinion 144 of the day index cam 122, while the date disc 88 is arranged to be driven by the pinion 152 of the date index cam 124, as will be described.

The day disc 86 is mounted on a hub 154 by a loose supporting engagement so that the day disc is not impeded in movement imparted thereto by pinion 144. As may be seen in FIG. 2, the day disc includes a central area 156 and an annular area 158 provided with peripheral gear teeth. The annular area is offset from the central area by a neck 160 including a shoulder 162. The central area may be inscribed or provided with means defining a decal or the equivalent providing indicia representative of the day of the week and the period of the day, i.e., either "AM" or "PM". Particularly, each day will be duplicated such as "MON AM" and "MON PM" in ordered sequence around the central area. A pluality of lugs 164, seven in number, are formed within the annular area, adjacent the gear teeth and at equidistant spacing around the disc. The lugs are disposed on the day disc on the side toward the date disc 88.

The date disc 88 of annular form is supported by the shoulder 162 of the day disc 86. The date disc substantially is equal in diameter to that of the day disc and within the annular body similarly may be inscribed or provided with a decal or the equivalent providing indicia representative of the dates of the month in ordered sequence from "1" to "31". The date disc is driven by pinion 152 through engagement with the gear teeth arond its outer periphery.

A pair of levers including a day index lever 166 and a data index lever 168 serve to maintain the day index cam 122 and date index cam 124, and consequently the day disc 86 and date disc 88, respectively, stationary except during an indexing operation. The function of the day and data index levers in an indexing operation will be further explained. Both the index levers are spring biased in the clockwise direction into contact with the respective index cam and are movable individually in the opposite direction following movement of that index cam. To this end, a shaft 170 secured in a manner as the shaft 126 (see FIG. 2) mounts both index levers by extending through a collar 172 on the day index lever 166 and a collar 174 on the date index lever 168. The index levers adjacent the collars each carry a tab 176 and 178 whose purpose is to secure one end of a helical torsion spring 180 and 182 received around the respective collars. The other end of each spring may be secured, for example, by structure (not shown) carried by rim 38 and the tab 184.

A sequence of operation of the calendar display changing mechanism may be seen in the FIGS. 3–6 which represent the position of the components of the indexing mechanism immediately after index of both the day and date discs at 12 o'clock midnight, the position of the components just prior to index of the day disc at 12 o'clock noon, the position of the components during the last-mentioned index and the position of the components during index of both the day and date discs at 12 o'clock midnight, respectively.

Each indexing operation be it an index of the day disc 86 or both the day disc and the date disc 88 is initiated by 12-hour cam 80. The 12-hour cam is carried by bushing 74 of the hour gear and driven in the direction indicated by the arrow (see FIG. 11) through engagement of the projection 116 with one wall of cutout 118 and completes a full revolution during each 12-hour period. The manner of mounting the 12-hour cam permits movement of the 12-hour cam rapidly foward of the hour gear through a lost motion connection of the projection and cutout, which may be of about 45° in length. Therefore, while the 12-hour cam is driven by the projection on bushing 74 so that the tip of the tear drop 112 rides along the cam surface 114 causing the indexing sector slowly to pivot in the counter-clockwise direction in opposition to the action of spring 104, the parts will be as illustrated in FIG. 11; whereas, when the tip of the tear drop portion 112 leaves the surface 114 at the sharp drop off the indexing sector rapidly returns to the positon against stop 106, simultaneously imparting a rapid "kick" to the 12-hour cam causing it to advance through a rotational angle equal to the angular length of cutout 118 (see FIG. 3). The ability of the indexing sector to return rapidly to the normal position against stop 106 enables a rapid index of either of both of the day and date discs 86 and 88 whereby the indicia carried thereby may be viewed fully at the apertures 64 and 66. The ability of the calendar display changing mechanism to rapidly index these discs is one of the important aspects of the invention.

A spring 188 secured at one end to a post 186 carried on the underside of movement plate 26 and at the other end to stop 106 provides a dampening effect to the rapid advance of the 12-hour cam thereby to absorb rotational shock on the clock hands because of the lost motion connection. For this purpose the securements are disposed radially beyond the path of the tip of the tear drop portion 112 while the spring of elongated, leaf make-up extends into although substantially tangent to the path. The wiping action, thus, slows the 12-hour cam obviating the rotational shock of the projection 116 hitting the other surface, yet permits substantially rapid advance.

As indicated, each indexing operation is initiated by movement of the 12-hour cam 80 controlling pivotal movement of the indexing sector 82. Thus, as the indexing sector is pivoted counterclockwise a driving engagement of the gear teeth within the gear sector porton 96 and the gear teeth formed on hub 132 causes the indexing pinion 120 to rotate clockwise through a partial revolution determined in part by the number of gear teeth within the gear sector portion. Movement of the indexing pinion will be through substantially one-half of a revolution. During this movement the day index lever 166 and the date index lever 168 maintain their respective index cams in the position of FIG. 7. Movement of the indexing sector, however, causes the indexing pinion through interaction of the follower projections 142 along the cam track 138 to move downwardly toward the movement plate 26 (see FIG. 9) so that the follower projections are capable of leaving their respective notches, whereby they travel along the surface of the upper portion 134 and enter into opposite notches 136 as the indexing pinion completes its designed partial revolution. The day index cam, then, through engagement of the rear surface of each follower projection and the vertical surface within notch 136 opposite the cam track 138 rotates conjointly with the indexing pinion in the counterclockwise direction thereby driving the day disc 86 in the clockwise direction. Movement of the day disc will be through an advance of approximately one-fourteenth of a full revolution to the position as illustrated in FIG. 3. As the day index cam rotates the respective extension or paddle of plate portion 140 causes the day index lever 166 to pivot counterclockwise against the bias of spring 182. The day index lever, after passing an overcenter position, will provide additional counterclockwise impetus in movement of the date index cam. The overcenter position is the position following approximately 90° of rotation when the tip of the extension moves beyond the surface of the index lever.

The data disc 88, also, will have completed an index to the FIG. 3 position, the indexing operation occurring substantially simultaneously with that of the index of the day disc 86. This action will be developed below.

Figure 4:
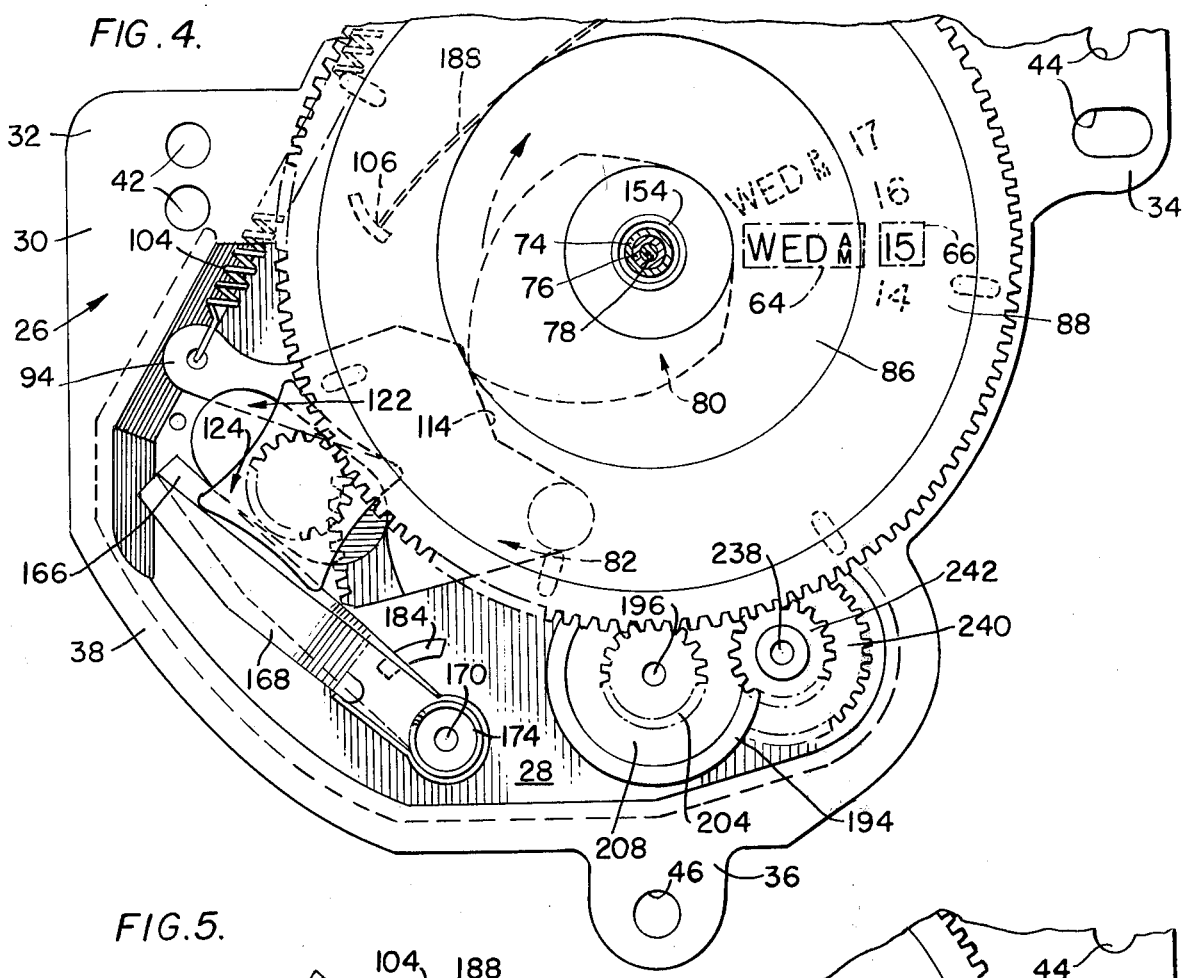
FIGS. 4–6 are views similar to FIG. 3 and together illustrate a sequence of indexing operations during a 24-hour period.
Figure 5:
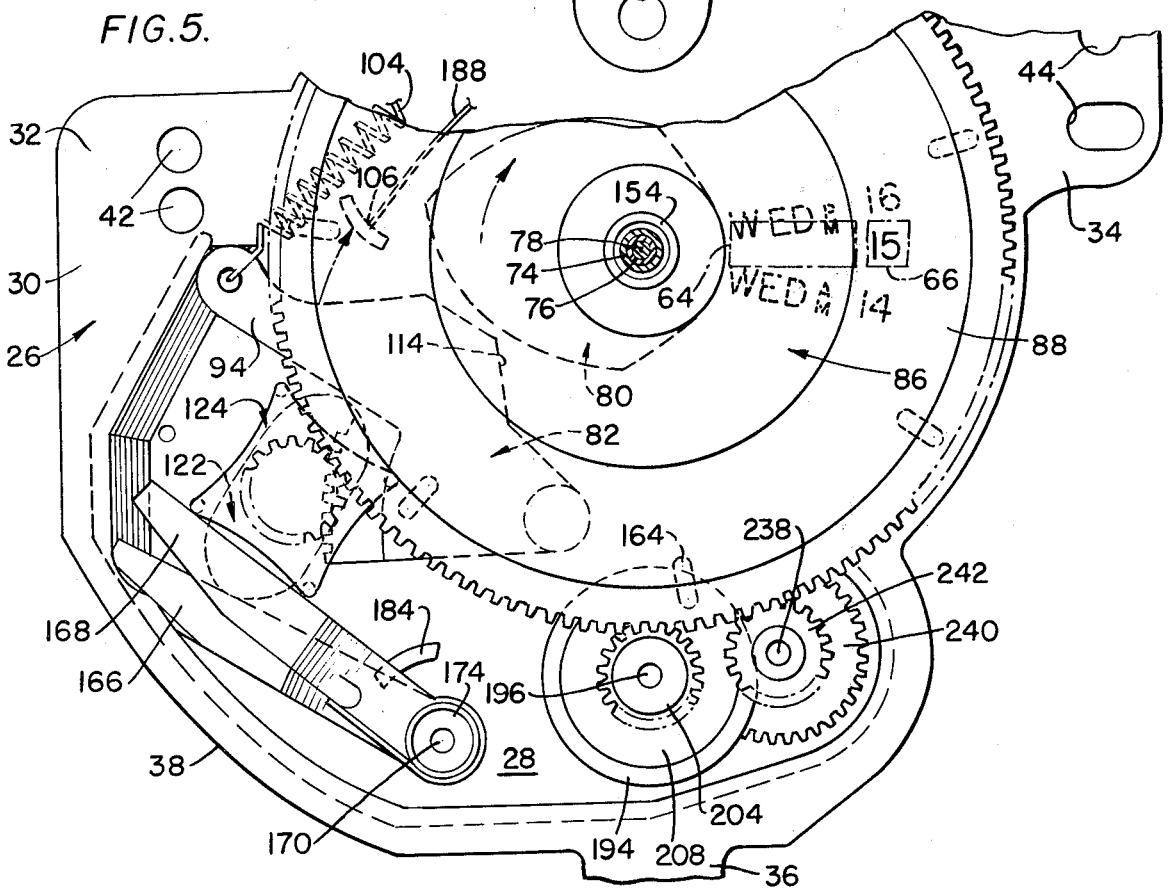

FIGS. 4 and 5 illustrate the relationship of the components of the calendar display changing mechanism prior to an index of the day disc 86 at 12 o'clock noon. Thus, in FIG. 4 the 12-hour cam 80 has been driven to a position whereby the end of the tear drop porton 112 is about to leave the camming surface 114. This action has resulted in the indexing sector 82 undergoing full counterclockwise pivotal movement and the indexing pinion 120 its designed partial clockwise rotation. In FIG. 5 the 12-hour cam is illustrated as having been "kicked" to an angularly forward disposition relative to the position of the hour gear, the indexing sector 84 is illustrated in a position of clockwise return toward stop 106 and the day index cam 122 is about to pass the overcenter position, all as discussed. These operative actions resulting from the return movement of indexing sector 82 to the position of the stop cause an index of one or both of the day and date discs. In FIG. 5, the new day indicia is coming into view at aperture 64.

The indexing of the date disc 88 is accomplished each and every time the day disc 86 undergoes two indexing operations. As will be described, the day disc controls the operation of the date index cam 124.

Turning to FIG. 3, immediately after index of the day and date discs at 12 o'clock midnight the former disc will have been positioned so that the lugs 164 reside in the dispositions illustrated, i.e., one lug will be approaching the indexing assembly 84, a second lug will have passed the indexing assembly by a few angular degrees, and so forth. In FIG. 5, the day disc 86 is illustrated in the process of undergoing index, during which process each of the lugs are moved clockwise thereby to be disposed after index in the position indicated by the arrowheads.

Figure 6:
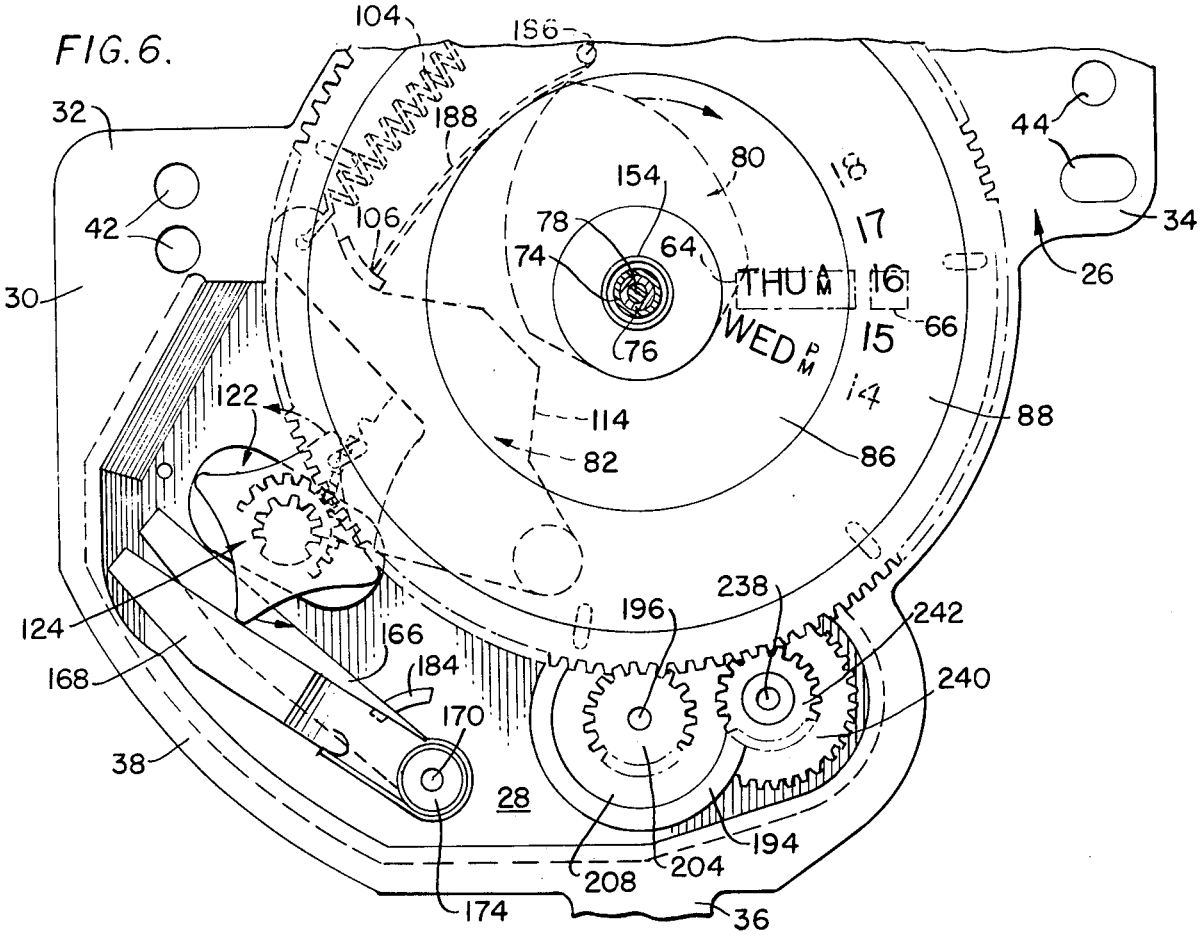

With reference to FIG. 6, the indexing sequence of the day disc 86 is substantially complete and the indexing of the data disc 88 is moving to completion. To this end, movement of the day disc causes the lugs 164 to advance to the position at which a lug abuts against one of the pins 150 of the date index cam thereby causing it to undergo counterclockwise rotation. The plate portion 146 of the index cam during this time engages the date index lever 168 pivoting it against the bias of spring 184. The date index cam will be driven in the stated direction by the lug until the index cam moves beyond the overcenter position of FIG. 6. The date index lever then functions to complete the rotational movement of the date index cam and consequently the date disc 88. While the movement of the date disc will lag the movement of the day disc somewhat, for all intents and purposes the movement of the two discs will be substantially simultaneous and each index will be completed rapidly.

Indexing of both the day disc 86 and date disc 88 at 12 o'clock midnight will require a greater force than is required to index only the day disc at 12 o'clock noon. The force required for these movements is developed by the spring 104 acting between the arm 94 of the indexing sector 82 and the member 108 as well as that developed by one or both springs 180 and 182 acting on the day and date index levers 166 and 168. The force of spring 104 remains constant in both operations and to more closely balance the total force developed in the index at 12 o'clock noon and the index at 12 o'clock midnight the shorter extension or paddle of the day index cam will act against the day index lever 166 upon occurrence of the latter index. If the forces are $F_1$ (104), $F_2$ (180) and $F_3$ (182), the force $F_2$ at 12 o'clock midnight will be less than the force $F_2$ at 12 o'clock noon, although complemented with the force $F_3$. This permits the spring 104 to index both the single and double index without over or under-powering either one of them.

The previous discussion concerns the automatic indexing of the day and date discs 86 and 88. On occasion it also may be necessary to index the discs selectively in the event, for example, of a power failure or when a particular month includes less than 31 days.

In connection with the following discussion attention is directed to FIGS. 12–15. The selective calendar display changing mechanism includes a day clutch 190, a date clutch 192 and clutch disc 194, all of which are mounted on a stem 196. A clutch pinion 198 is press fit on the stem between its ends and the stem is biased by spring 200 to the position of FIG. 12 whereby the clutch pinion is in engagement with the gear teeth of a clutch sector 216. To this end, a set pinion 202 is press fit on the end of the stem and the spring is received between the set pinion and the lower surface of movement plate 26.

Each of the day and date clutches are substantially similarly formed thereby to provide a pinion portion 204 and 206, a flange portion 208 and 210, and a skirt portion 212 and 214, which depends from the flange portion. Both the flange portions overlie the clutch disc 194, while the skirt portions are juxtaposed to the clutch disc on opposite sides.

Figure 12:
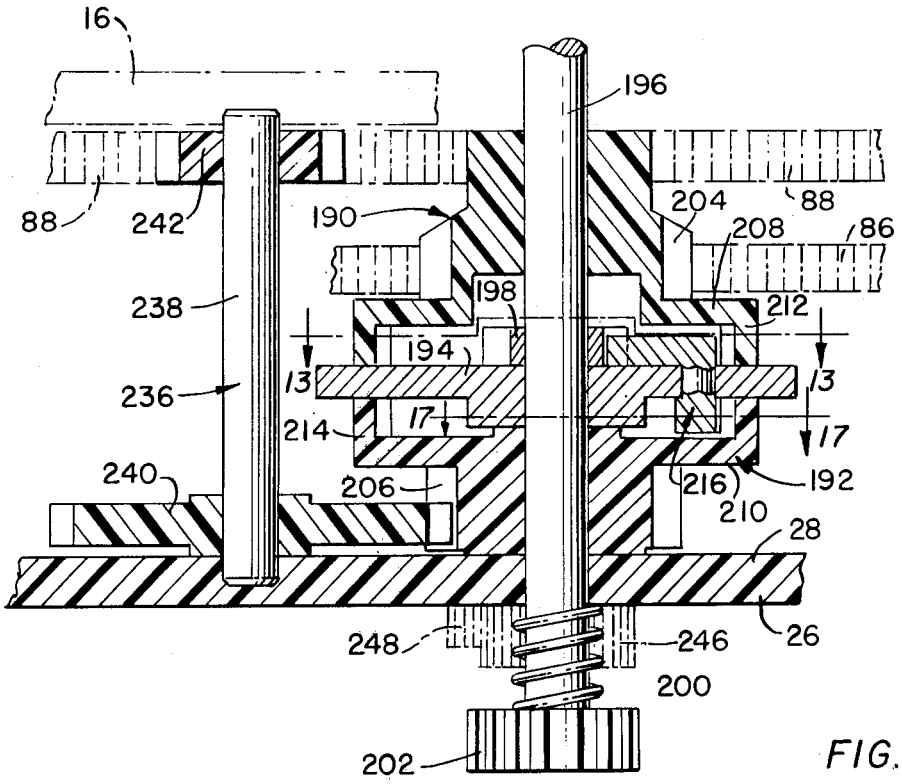
FIG. 12 is a view in vertical section along the line 12—12 in FIG. 3 illustrating the selective indexing mechanism.
Figure 15:
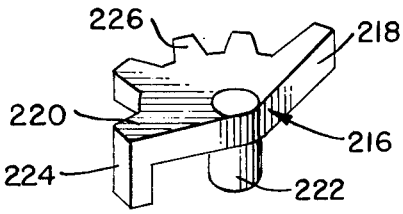
FIG. 15 is a view in perspective of the clutch sector of the selective indexing mechanism.
Figure 13:
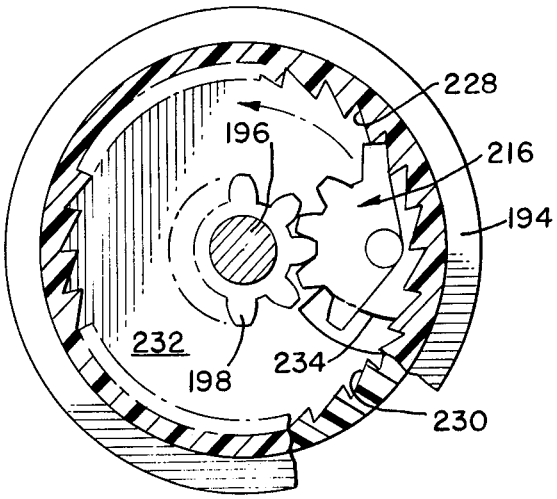
FIG. 13 is a horizontal section along the line 13—13 in FIG. 12 with a portion of the structure broken away.
Figure 14:
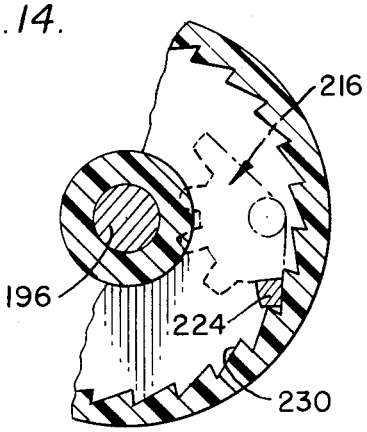
FIG. 14 is a view in horizontal section along the line 17—17 in FIG. 12.

The clutch disc provides a mount for the clutch sector 216, the structure and operation of which now will be set out. Turning to FIG. 15, the clutch sector 216 includes a pair of arms 218 and 220 extending oppositely from the axis of a post 222. One of the arms includes an extension 224 and a gear sector 226 is disposed between the arms. As illustrated in FIG. 12 the post of the clutch sector is received through an opening in the clutch disc for pivotal movement imparted to the clutch sector upon rotation of the stem 196 and engagement of the clutch pinion 198 and gear sector 226.

Both of the day and date clutches 190 and 192 are provided with ratchet teeth for cooperation with the end of arm 218 and extension 224 which define a pawl. To this end, the former clutch includes ratchet teeth 228, while the latter clutch includes oppositely directed ratchet teeth 230. The ratchet teeth are formed within and around the skirt portions 212 and 214 of the two clutches.

As indicated, the clutch sector is pivotally received through an opening in the clutch disc whereby the gear sector 224 and arms 218 and 220 are juxtaposed to the upper surface 232 of clutch disc 194 and the extension 224 is accommodated in a cutout 234. Thus, one pawl will cooperate with the ratchet teeth 228 while the other pawl will cooperate with the ratchet teeth 230 as determined by the pivotal location of the clutch sector 216.

Operation in selectively indexing the calendar display is carried out through rotation of the stem 196 either in the clockwise or counterclockwise direction thereby to index the date disc 88 and the day disc 86 (the date disc will also index upon every second ndex of the day disc in a manner, as previously discussed), respectively. Thus, the initial rotation of the stem and the clutch pinion 198, referring to FIGS. 13 and 14, causes the clutch sector to pivot in the selected direction thereby to engage a pawl with one set of ratchet teeth and at the same time to disengage the other pawl from the other set of ratchet teeth. Continued rotation of the stem results in the one clutch or the other, coupled to the stem through the pawl, clutch sector and clutch pinion, to rotate thereby to rotate the day or date disc. Thus, clockwise rotation of stem 196 causes the date clutch 192 and consequently pinion portion 206 to rotate. A reversing gear 236 including a stem 238 and a pinion 240 and 242 at opposite ends is interposed between the pinion portion 206 and the date disc 88. The reversing gear may be an integral unit or else the pinions may be press fit or otherwise immovably carried by the stem for conjoint movment. Thus, the reversing gear 236 drives the date disc 88 for stepped index through a drive train including pinion portion 206, pinion 240, stem 238 and pinion 242. Similar operation is obtained when the day disc is to be indexed. Thus, the stem 196 is rotated in the counterclockwise direction, first engaging the pawl of the clutch sector 216 with ratchet teeth 228 and upon continued rotational movement rotating pinion portion 204 and day disc 86 which is in driven engagement. When one or the other of the day and date discs 86 and 88 is to be indexed selectively the clutch which is not controlled through engagement of the respective ratchet teeth and pawl will remain stationary. To this end, the immobilizing effect of the respective index lever on its associated inex cam will overcome any friction that may develop between the day and date clutches 192 and 194 and the interposed clutch disc 196 thereby to frictionally couple one to another.

The step 238 of reversing gear 236 extends beyond the pinions 240 and 242 whereby the stem may be mounted in the manner of mounting shaft 126.

The stem 196 is elongated in form thereby to extend forwardly of the lens assembly 18 suitably apertured at 244. A knob 246 secured to the stem facilitates movement as described and now to be described.

It was previously brought out that the stem 196 is biased to the position of FIG. 12 whereby the set pinion 202 is out of driving engagement with the gear 248 of a gear train also including gear 250 and the hour gear 252, for example. If, however, the hands of the timepiece 10 are to be adjusted the stem is drawn in the direction opposite the direction of the spring bias thereby to engage the set pinion with gear 248 of the drive train just mentioned. The clutch pinion 198 follows the longitudinal movement of the stem to disengage from the gear sector 226 of clutch sector 216. Consequently, rotation of the stem 196 has no effect in movement of either the day disc 86 or date disc 88 other than as automatically moved under control of the 12-hour cam 80.

Having described the invention with particular reference to the preferred form thereof, it will be obvious to those skilled in the art to which the invention pertains after understanding the invention, that various changes and modifications may be made therein without departing from the spirit and scope of the invention as defined by the claims appended hereto.

Having described the invention, what is claimed is:

1. Apparatus for rapidly changing calendar information displayed in a timepiece, comprising:

a. support means;

b. means carried by said support means having an aperture for viewing said calender information;

c. first calendar means including 1. a first surface area of annular outline,
2. a second surface area disposed radially inwardly of said first surface area, and
3. alpha indicia representative of each of the days of the week in ordered sequence and wherein said alpha indicia is presented in substantial duplicate with each presentation including means thereby indicative of one twelve hour period as distinguished from an adjacent presentation which is indicative of another twelve hour period, said alpha indicia disposed in one of said surface areas at equiangular positions about an axis of rotation of said first calendar means;

d. means for mounting said first calender means on said support means for movement about said axis relative to said support means;

e. second calendar means having numeric indicia in ascending order from 1 to 31, said numeric indicia disposed on said calendar means at equiangular positions about said axis;

f. means on said first calendar means for mounting said second calender means whereby said calendar means are adapted for independent movement about said axis; and g. means carried by said support means for moving rotationally each of said calendar means through substantially instantaneous advance under control of said timepiece at the end of each second 12-hour period and said first calendar means through substantially instantaneous advance at the end of intermediate 12-hour periods, said first calendar means controlling said advance of said second calendar means.

2. The apparatus of claim including decal means, said decal means carrying said alpha and numeric indicia and received by said first and second calendar means, respectively.

3. The apparatus of claim 1 wherein said first calendar means is formed by a disc whose first and second surface areas are parallel and laterally offset one from the other, and including means connecting said surfaces, said connecting means including a shoulder adjacent one of said surface areas.

4. The apparatus of claim 3 wherein said shoulder is disposed adjacent said second surface and comprises said means for mounting said second calendar means, said second calendar means formed by an annular ring and disposed substantially in the plane of said second surface.

5. The apparatus of claim 4 wherein said indicia is disposed in said plane.

6. The apparatus of claim 1 wherein said first and second surface areas of said first calendar means are laterally offset and said second calendar means if formed by an annular ring whereby when mounted by said mounting means said second calendar means overlies said first surface area of said first calendar means.

7. The apparatus of claim 6 wherein each of said calendar means include a complement of gear teeth around its outer periphery, and wherein said moving means includes pinion means engaging with said gear teeth.

8. The apparatus of claim 7 including a prime mover, a plurality of hands whose positional relationship denotes the time of day in at least hours and minutes, drive train means driven by said prime mover for driving said hands, said drive train means including means for mounting said hands, and control means for actuating said moving means, said control means drivingly supported by said hour hand mounting means.

9. The apparatus of claim 8 wherein said control means includes a hub portion having an aperture therethrough and an angular cutout communicating with said aperture, and said means mounting said hour hand including a bushing having a projection, said bushing received through said aperture whereby said projection cooperates in said cutout thereby providing a lost motion connection between said control means and said means mounting said hour hand.

10. The apparatus of claim 8 wherein said control means is drivingly supported by said hour hand mounting means through lost motion connection means, said moving means further including an indexing sector having a sector gear portion, means mounting said indexing sector for pivotal movement on said support means thereby to move in one direction from a first limit position upon driven movement of said control means, a main spring connected to said indexing sector normally biasing said indexing sector to said first limit position, and an indexing pinion in driven engagement with said sector gear portion thereby to be rotated in one direction as said indexing sector moves pivotally from said first limit position and in the reverse direction as said indexing sector returns to said first limit position from a second limit position.

11. The apparatus of claim 10 wherein said control means acts on said indexing sector whereby said indexing sector pivots from said first to said second and back to said first limit position twice and at equally spaced intervals during each 24-hour period.

12. The apparatus of claim 10 wherein said indexing sector includes a camming surface terminating in a sharp drop-off such that said control means driven by said hour hand mounting means moves along said surface to said drop-off thereby pivoting said indexing sector slowly toward said second limit position and when said control means arrives at said drop-off said mainspring acts to rapidly return said indexing sector to said first limit position, said indexing sector causing said control means through said lost motion connection also to rapidly advance.

13. The apparatus of claim 12 including dampening means, said dampening means formed by an elongated leaf spring, means mounting said dampening means in the path of movement of said control means whereby said control means brushes along but is not prevented in movement by said leaf spring during said rapid advance thereby to absorb some of the forward thrust imparted by said indexing sector.

14. The apparatus of claim 10 wherein said moving means further includes day cam means, shaft means mounting each of said day cam means, indexing pinion and pinion means engaging said first and second calendar means in stacked relation, spring means normally biasing said indexing pinion toward said day cam means, and means carried by said day cam means and said indexing pinion for coupling the same whereby only when said indexing pinion is rotated in said reverse direction does said day cam means directly follow said movement.

15. The apparatus of claim 14 including day lever means, means mounting said day lever means on said support means for pivotal movement, spring means biasing said day lever means into contact with said day cam means thereby to maintain said day cam means stationary when said indexing pinion is rotated in said one direction.

16. The apparatus of clam 14 wherein one of said pinion means is movable with said day cam means for rotating said first calendar means.

17. The apparatus of claim 16 including day lever means, means mounting said day lever means for pivotal movement, means biasing said day lever means toward said day cam means, said biasing means being loaded during rotation of said day cam means to an overcenter position relative to said day lever means and thereafter together with said mainspring providing a force for rapidly rotating said first calendar means.

18. The apparatus of claim 17 including a plurality of lugs, said lugs being supported equiangularly around said first surface of said first calendar means, and wherein said moving means further includes date cam means, said date cam means being supported for rotation by said shaft means and including pin means disposed to be engaged sequentially by said lugs during certain degres of rotational movement of said first calendar means thereby to impart rotational movement to said date cam means, said day cam means mounted adjacent said date cam means.

19. The apparatus of claim 18 including date lever means, means mounting said date lever means for pivotal movement, means biasing said date lever means toward said date cam means, said biasing means normally maintaining said date cam means stationary except when said pin means is engaged by said lugs thereby being loaded during rotation of said first calendar means to an overcenter position and thereafter together with said biasing means of said day lever means and said mainspring providing a force to rapidly rotate said second calendar means.

20. The apparatus of claim 19 wherein said day cam means includes a plate portion, one extension of said plate portion being longer than the other extension said extension acting to pivot and load said day lever means when an index of both said first and second calendar means is carried out.

21. The apparatus of claim 19 wherein the other of said pinion means is movable with said date cam means for rotating said second calendar means.

22. The apparatus of claim 1 including a stem, said stem being mounted by said support means for rotation about a second axis thereby adapted for selectively indexing at least one or the other of said first and second calendar means, each said first and second calendar means including gear teeth around their outer periphery, means drivingly engaging said gear teeth, and means between said engaging means and stem responsive to rotational movement of said stem for driving a selected one of said calendar means.

23. The apparatus of claim 22 wherein said means responsive to rotational movement comprises a day clutch, a date clutch, each said clutch including ratchet teeth disposed in an oppositely directed annular array, pawl means, means supporting said pawl means for engagement with said ratchet teeth, and means carried by said stem whereby upon rotation said pawl means is activated for engagement with said ratchet teeth of one array.

24. The apparatus of claim 23 wherein each clutch includes a clutch pinion, one of said clutch pinions disposed in direct driving engagement with one of said calendar means, and wherein said apparatus further includes reversing gear means, said reversing gear means interposed between and in driving engagement with the other of said calendar means and clutch pinions.

* * * * *

UNITED STATES PATENT AND TRADEMARK OFFICE

CERTIFICATE OF CORRECTION

PATENT NO. : 4,059,953

DATED : November 29, 1977

INVENTOR(S) : David Morrison et al

It is certified that error appears in the above-identified patent and that said Letters Patent are hereby corrected as shown below:

In the Abstract, col. 2, line 4, "pivota" should be --pivotal--.

line 53, "automibile" should be --automobile--.
Col. 3, line 57, "assemblu" should be --assembly--;
line 61, "tranparency" should be --transparency--.
Col. 4, line 53, "f" should be --of--.
Col. 5, line 18, "section" should be --sector--;
line 44, "section" should be --sector--;
line 47, "section" should be --sector--.
Col. 6, line 6, "section" should be --sector--.
Col. 7, line 3, "arond" should be --around--;
line 5, "data" should be --date--;
line 9, "data" should be --date--;
line 42, "foward" should be --forward--.
Col. 8, line 48, "data" should be --date--;
line 63, "84" should be --82--.
Col. 9, line 20, "data" should be --date--.
Col. 10, line 44, "ndex" should be --index--.
Col. 11, line 8, "inex" should be --index--;
line 12, "step" should be --stem--.

UNITED STATES PATENT AND TRADEMARK OFFICE

CERTIFICATE OF CORRECTION

PATENT NO. : 4,059,953

DATED : November 29, 1977

INVENTOR(S) : David Morrison et al

It is certified that error appears in the above-identified patent and that said Letters Patent are hereby corrected as shown below:

In the Claims, (Col. 11), Claim 1, line 45, "calender" should be --calendar--;
line 60, "calender" should be --calendar--;
line 68, "calender" should be --calendar--.
Claim 2, (Col. 12), after "claim" insert --1--.
Claim 16, (Col. 13), line 49, "clam" should be --claim--.
Claim 18, (Col. 14), line 8, "degres" should be --degrees--.

Signed and Sealed this

*Fourteenth* Day of *November 1978*

[SEAL]

*Attest:*

RUTH C. MASON
*Attesting Officer*

DONALD W. BANNER
*Commissioner of Patents and Trademarks*